US008769845B2

(12) United States Patent
Lin

(10) Patent No.: US 8,769,845 B2
(45) Date of Patent: Jul. 8, 2014

(54) SHOE CONVENIENTLY PUT ON AND TAKEN OFF

(76) Inventor: Shu-Hua Lin, Taichung (TW)

( * ) Notice: Subject to any disclaimer, the term of this patent is extended or adjusted under 35 U.S.C. 154(b) by 343 days.

(21) Appl. No.: 13/008,435

(22) Filed: Jan. 18, 2011

(65) Prior Publication Data

US 2012/0180338 A1 Jul. 19, 2012

(51) Int. Cl.

| | |
|---|---|
| ***A43B 11/00*** | (2006.01) |
| ***A43B 23/02*** | (2006.01) |
| ***A43B 9/02*** | (2006.01) |
| ***A43B 11/02*** | (2006.01) |
| ***A43B 21/24*** | (2006.01) |
| ***A43B 23/04*** | (2006.01) |
| ***A43B 23/26*** | (2006.01) |
| ***A43C 11/00*** | (2006.01) |

(52) U.S. Cl.

CPC ..... *A43B 23/0215* (2013.01); *A43B 9/02* (2013.01); *A43B 11/02* (2013.01); *A43B 21/24* (2013.01); *A43B 23/025* (2013.01); *A43B 23/027* (2013.01); *A43B 23/047* (2013.01); *A43B 23/26* (2013.01); *A43C 11/006* (2013.01); *A43C 11/002* (2013.01)

USPC ..... 36/138; 36/56

(58) Field of Classification Search

CPC ..... A43B 11/00; A43B 11/02; A43B 23/26

USPC ..... 36/56, 138, 88, 93, 54

See application file for complete search history.

(56) References Cited

U.S. PATENT DOCUMENTS

| | | | | | |
|---|---|---|---|---|---|
| 2,139,858 | A * | 12/1938 | Schwartz et al. | 36/54 |
| 2,915,837 | A * | 12/1959 | Schlecht | 36/72 R |
| 3,693,270 | A * | 9/1972 | Murray | 36/58.5 |
| 4,608,769 | A * | 9/1986 | Sturlaugson | 36/68 |
| 4,805,321 | A * | 2/1989 | Tonkel | 36/54 |
| 5,054,216 | A * | 10/1991 | Lin | 36/138 |
| 5,090,140 | A * | 2/1992 | Sessa | 36/138 |
| 5,276,983 | A * | 1/1994 | Hatfield | 36/138 |
| 5,740,618 | A * | 4/1998 | Minden | 36/8.3 |
| 5,813,149 | A * | 9/1998 | Baker et al. | 36/138 |
| 6,874,255 | B2 * | 4/2005 | Bernstein | 36/50.1 |
| 6,877,252 | B2 * | 4/2005 | Wilkinson | 36/11.5 |
| 6,880,272 | B2 * | 4/2005 | Wells | 36/138 |
| 7,188,438 | B1 * | 3/2007 | Bowen | 36/7.1 R |
| 2002/0139009 | A1 * | 10/2002 | Mark | 36/54 |

* cited by examiner

*Primary Examiner* — Jila M Mohandesi

(74) *Attorney, Agent, or Firm* — Muncy, Geissler, Olds & Lowe, P.C.

(57) ABSTRACT

A shoe that is conveniently put on and taken off includes an outsole, an upper, a supporting piece, and a guiding piece. The upper is attached on the outsole and has a counter and a collar extending upward from the counter and configured as a shoehorn. The supporting piece is attached to the counter and the collar of the upper. The guiding piece is attached to an instep of the upper. Because of the supporting piece having a predetermined hardness and the collar having a shape like a shoehorn, the rear of the upper can be served as a shoehorn for helping a user's foot in slipping into the shoe. In addition, the guiding piece can avoid the instep of the upper from becoming crease and unsmooth. As a result, the shoe is convenient for the user to put on without bending his back and using his hand.

6 Claims, 2 Drawing Sheets

SHOE CONVENIENTLY PUT ON AND TAKEN OFF

BACKGROUND OF THE INVENTION

1. Field of the Invention

The present invention relates generally to shoes and more particularly, to a shoe which can be put on and taken off conveniently.

2. Description of the Related Art

Modern people are so busy in such a way that everything in living, including putting shoes on and taking them off, is requested to be done efficiently and conveniently. Therefore, many tools or skills that help putting on and taking off shoes are well developed. For example, when putting on a shoe that will cover widely the user's foot, some people have a habit of using a shoehorn or of pulling the tongue or the front of the shoe's top line for helping their foot in slipping into the shoe. When taking off a shoe, besides pulling, many people have a habit of treading on the counter at the rear of the shoe by the other foot so as to take off that shoe quickly. However, when taking any above-mentioned way, people will need to bend their backs and then touch the shoes or handle shoehorns, which is not so convenient to busy people, not to mention people who can't bend their backs easily, such as old people, pregnant women, or patients with ankylosing spondylitis. Besides, a shoehorn is not available anywhere, and handling it needs skill. As to taking off the shoe, the way of treading on the counter of the shoe will make the shoe's upper deformed, dirty, or torn, and even make the shoe's outsole fall off.

SUMMARY OF THE INVENTION

The present invention has been accomplished in view of the above-noted circumstances. It is an objective of the present invention to provide a shoe which can be put on and taken off conveniently.

To attain the above objective, the present invention provides a shoe comprises an outsole, an upper that is attached on the outsole and has a counter and a collar extending upward from the counter and configured as a shoehorn, a supporting piece which is harder than the upper and attached to the counter and the collar of the upper, and a guiding piece which is harder than the upper and attached to an instep of the upper and having a part extending out of a top line of the upper. Since the supporting piece has a predetermined hardness and the collar is configured like a shoehorn, the rear of the upper is provided with a portion having a similar function to a shoehorn. The guiding piece is also useful for avoiding the instep from becoming crease and unsmooth. As a result, a user's foot is able to slide into the shoe along the aforesaid portion, so that the shoe is convenient for the user to put on without bending his back and using his hand.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
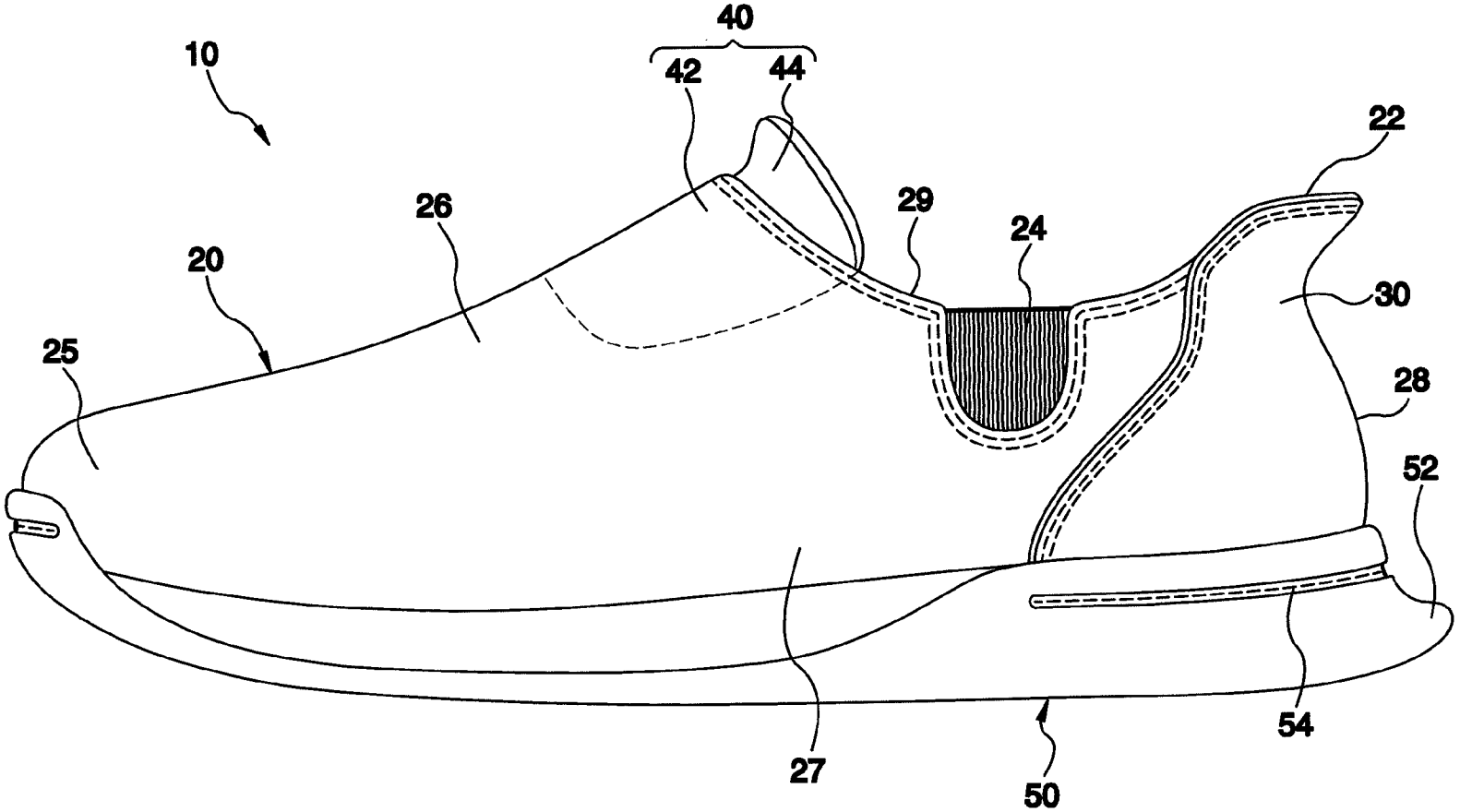
FIG. 1 is a side view of the shoe in accordance with a preferred embodiment of the present invention.
Figure 2:
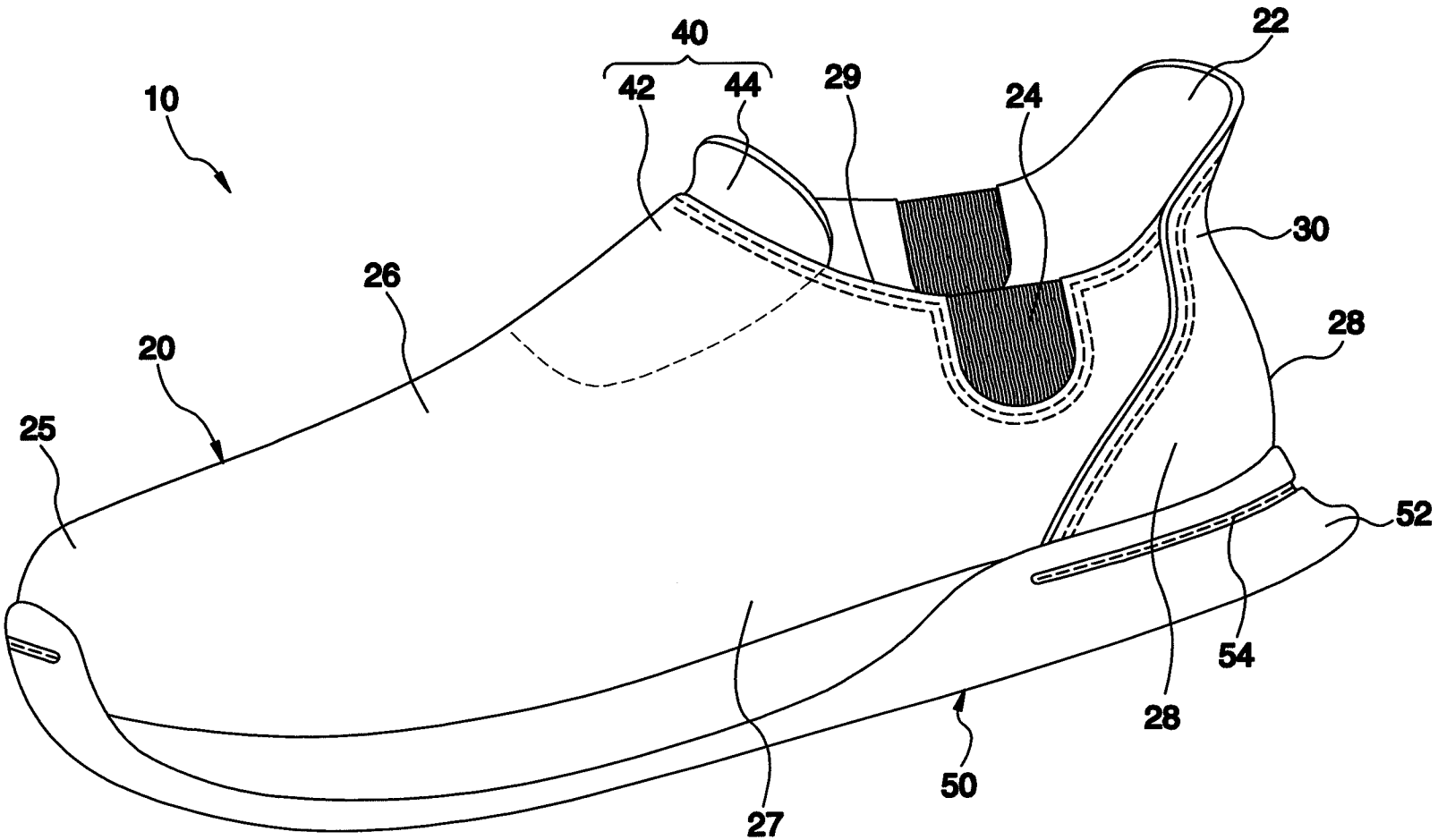
FIG. 2 is a schematic perspective view of the shoe in accordance with the preferred embodiment of the present invention.

FIG. 1 and FIG. 2 show a shoe, denoted by reference numeral 10, in accordance with a preferred embodiment of the present invention, which can be conveniently put on and taken off. The shoe 10 comprises an upper 20, a supporting piece 30 and a guiding piece 40 both attached to the upper 20, and an outsole 50.

The upper 20 is similar to those of conventional shoes, but in this embodiment the upper 20 has a collar 22 and two elastic bands 24. Specifically speaking, like uppers of conventional shoes, the upper 20 can be divided into a toe portion 25, an instep 26 and two quarters 27 extending backward from the toe portion 25, and a counter 28 connecting the quarters 27. The collar 22 extends upward and backward from the counter 28 integrally in such a way that the collar is configured as a shoehorn. The tops of the instep 26, the counter 28, and the quarters 27 are connected to form a top line 29 of the upper 20. The elastic bands 24 are located in the quarters 27 respectively and near the counter 28, and the tops of the elastic bands 24 are parts of the top line 29. As a result, the size of the top line 29 can be adjusted by stretching or relieving the elastic bands 24.

The supporting piece 30 and the guiding piece 40 are made from thermoplastic polyurethane (TPU), polyvinyl chloride (PVC), Nylon, polypropylene (PP), polycarbonate (PC), or acrylonitrile butadiene styrene copolymer (ABS), and are harder than the upper 20. The supporting piece 30 has a shape corresponding to the counter 28 and the collar 22 of the upper 20, and is attached to the outside of them by sewing, which means the supporting piece 30 is exposed outside the upper 20 and will not be in contact with the user's foot. The guiding piece 40 has a fixed portion 42 and a guiding portion 44 integrally connected with the fixed portion 42. The fixed portion 42 is attached between an outside of the instep 26 and an inside of the instep 26 by sewing, which means the fixed portion 42 is not exposed outside the upper 20 and will not be in contact with the user's foot. The guiding portion 44 extends through the top line 29 out of the upper 20 upward and slightly frontward. The fixed portion 42 has a shape like the instep of the user.

The outsole 50 is similar to those of conventional shoes, but the outsole 50 has a treadable protrusion 52 at the rear end of the outsole 50, so that the user can take the shoe 10 off his one foot by the other foot treading on the treadable protrusion 52. The upper 20 is attached on the outsole 50 with adhesive, and in order to avoid the outsole 50 from separation from the upper 20, the rear portions of the outsole 50 and the upper 20 are seamed together with a sewing thread 54.

Because of the supporting piece 30 having a predetermined hardness and the collar 22 having a shape like a shoehorn, the rear of the upper 20 is provided with a portion that can be served as a shoehorn for helping the user's foot in slipping into the shoe 10 along that portion when the user puts on the aforesaid shoe 10; meanwhile, the guiding piece 40 is also useful for avoiding the instep 26 from becoming crease and unsmooth. To take off the shoe 10 quickly, the user can tread on the treadable protrusion 52 of the outsole 50 and make his instep slide out of the shoe 10 along the guiding portion 44 of the guiding piece 40. Besides, during aforesaid process of putting on or taking off the shoe 10, the elastic bands 24 can be stretched to enlarge the top line 29, so that the user can put on or take off the shoe 10 more smoothly. As a result, the shoe 10 is convenient for the user, especially for old people, pregnant women, or wounded people who can't bend their backs easily, to put on without bending his back and using his hand. Except for the collar 22, the upper 20 is the same with those of conventional shoes, so the shoe 10 will not fall off the foot easily if it is used normally.

It will be appreciated that the aforesaid supporting piece 30 can be attached to the inside of the upper 20, and the guiding piece 40 can be attached to the outside of the upper 20. And further, the supporting piece 30 and the guiding piece 40 both can be attached between the outside and the inside of the upper 20, in that case, the supporting piece 30 and the guiding portion 44 of the guiding piece 40 are not exposed outside the upper 20, and will not be in contact with the user's foot.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A shoe, comprising:

an outsole;

an upper which is attached on the outsole and has a counter and a collar extending upward from the counter and configured as a shoehorn;

a supporting piece which is harder than the upper and attached to the counter and the collar of the upper; and a guiding piece, wherein the entire guiding piece is harder than the upper and the guiding piece is attached directly to an instep of the upper and having a part extending out of a top line of the upper;

wherein the guiding piece is attached to an inside of the upper or between an outside of the upper and the inside of the upper.

2. The shoe as claimed in claim 1, wherein the supporting piece is attached to an outside or an inside of the upper.

3. The shoe as claimed in claim 1, wherein the outsole has a treadable protrusion at a rear end of the outsole.

4. The shoe as claimed in claim 1, wherein a quarter of the upper has an elastic band near the counter.

5. The shoe as claimed in claim 4, wherein the outsole has a treadable protrusion at a rear end of the outsole; rear portions of the outsole and the upper are seamed together with a sewing thread.

6. The shoe as claimed in claim 3, wherein the treadable protrusion extends farther from a rear end of the shoe than any portion of the supporting piece and the collar.

* * * * *